US006094333A

United States Patent [19]

Kato

[11] Patent Number: 6,094,333

[45] Date of Patent: Jul. 25, 2000

[54] OPERATION CONTROL METHOD FOR SUPERCONDUCTING COIL

[75] Inventor: Takeshi Kato, Osaka, Japan

[73] Assignee: Sumitomo Electric Industries, Ltd., Osaka, Japan

[21] Appl. No.: 09/176,327

[22] Filed: Oct. 22, 1998

[30] Foreign Application Priority Data

Oct. 24, 1997 [JP] Japan ..... 9-292671

[51] Int. Cl.[7] ..... H01H 97/00

[52] U.S. Cl. ..... 361/141; 361/19; 361/115

[58] Field of Search ..... 361/19, 141, 115

[56] References Cited

U.S. PATENT DOCUMENTS 3,643,002 2/1972 Minnich ..... 174/15
5,447,033 9/1995 Nagao et al. ..... 62/6

OTHER PUBLICATIONS

Katsutoki; "Superconductive Magnet Apparatus"; Publication No. 60 245285; Publication Date: Dec. 12, 1985; vol. 010, No. 108; (Apr. 23, 1986.

Kazuaki; "Conduction Cooling Superconduction Magnet Device"; Publication No. 07 086642 Publication Date: Mar. 31, 1995; vol. 095, No. 006; (Jul. 31, 1995).

Proceedings of the 8th International Workshop on Critical Currents in Superconductors, Edited by Teruo Matsushita et al., pp. 471–474, May 27–29/1996.

*Primary Examiner*—Stephen W. Jackson
*Attorney, Agent, or Firm*—Foley & Lardner

[57] ABSTRACT

A control method allowing stable operation of a refrigerator conduction cooling type superconducting coil employing an oxide high temperature superconductor is provided. Thermal resistance between a refrigerator and a superconducting coil connected to a cooling stage of the refrigerator is obtained. From the obtained thermal resistance and the rated cooling capacity of the refrigerator, an effective cooling curve representing the relation between the temperature and calorific value is obtained. Operation of the superconducting coil which is energized while being cooled by the refrigerator is controlled such that the calorific value of the superconducting coil at a prescribed temperature does not exceed the effective cooling curve.

11 Claims, 4 Drawing Sheets

OPERATION CONTROL METHOD FOR SUPERCONDUCTING COIL

BACKGROUND OF THE INVENTION

1. Field of the Invention

The present invention relates to a method of controlling operation of a refrigerator conduction cooling type superconducting coil and, more particularly, to a method of stably operating a refrigerator conduction cooling type superconducting coil constituting a superconducting magnet without quenching.

2. Description of the Background Art

Conventionally, a normal conductor such as copper and a metal based superconductor which is rendered superconductive at liquid helium temperature have been used for coils. When a high magnetic field is to be generated by using copper, it becomes necessary to cool by forced water flow, for example, as much heat is generated. A coil formed by using a normal conductor such as copper has the problems of large power consumption, difficulty in making a compact coil and laborious maintenance.

By contrast, a superconducting coil is useful in various applications, as a large magnetic field can be generated with a small power. However, when a metal based superconducting wire is used for a coil, cooling down to a cryogenic temperature (about 4 K) is necessary, resulting in much cost in cooling. Further, as the metal based superconductor is used at a cryogenic temperature with low specific heat, it is poor in stability and prone to quench.

Recently, techniques such as magnetic separation, crystal pulling and the like, which use an oxide high temperature superconducting coil which can be used at a relatively high temperature, have been proposed. The oxide high temperature superconducting coil can be used at a relatively high temperature as compared with the metal based superconducting coil, and therefore, can be used at a range with relatively high specific heat. It has been found that such use results in very good stability. Practical use of the oxide high temperature superconducting coil to make a more convenient magnet has been expected.

The oxide high temperature superconductor is rendered superconductive at liquid nitrogen temperature. At liquid nitrogen temperature, however, the oxide high temperature superconductor does not have very good critical current density and magnetic field characteristic at present. For this reason, the oxide high temperature superconductor has been used in a coil for generating a low magnetic field at present. The oxide high temperature superconducting coil, on the other hand, may possibly has higher performance at a temperature lower than liquid nitrogen temperature. For the use at a lower temperature, cooling by liquid helium is possible. The cost of cooling by liquid nitrogen, however, is high and the handling is difficult. In view of the foregoing, attempts using a refrigerator of which operation cost is relatively low and of which handling is simple have been made to cool the oxide superconducting coil to the cryogenic temperature.

The general method to find a stable operating range of the superconducting coil includes the steps of obtaining a load line and finding a stable operating range therefrom. An operating range derived from the load line is generally used for operating the metal based superconducting coils in both cases of a pool cooling type and a refrigerator conduction cooling type.

Similarly, the load line method may be used for an oxide high temperature superconducting coil. Here, the oxide high temperature superconductor has high critical temperature and makes a moderate transition to normal conduction, and therefore it has high stability and is not susceptible to quenching. It is expectable that, making use of this property, a current value in operating the coil can be increased to almost the critical current value. In addition, it is expectable that the operation current can be increased as much as possible while the oxide high temperature superconducting coil is cooled by a refrigerator of which operation cost is low and handling is easy. At present, however, on the oxide high temperature superconducting coil, its behavior in the refrigerator conduction cooling has not been sufficiently revealed, and therefore operation tests have to be done in order to find the stable operation range.

SUMMARY OF THE INVENTION

An object of the present invention is to find a new method for obtaining a stable operation range of a refrigerator conduction cooling type superconducting coil, and accordingly, to provide a method which can stably control the operation of the coil.

An additional object of the present invention is to provide a method which is suitable for controlling the operation of oxide high temperature superconducting coil of refrigerator conduction cooling type.

The present invention is directed to a method of controlling operation of a refrigerator conduction cooling type superconducting coil, which includes the steps of: obtaining thermal resistance between a refrigerator and a superconducting coil connected to the cooling stage of the refrigerator, obtaining an effective cooling curve representing the relation between temperature and amount of heat from the rated cooling capacity of the refrigerator and the thermal resistance, and controlling the operation of the superconducting coil which is energized while being cooled by the refrigerator such that the calorific value of the superconducting coil at a prescribed temperature does not exceed the effective cooling curve.

In the present invention, the calorific value on the superconducting coil may be obtained from the energized current and the resistance value of the superconducting coil, and the operation current of the superconducting coil may be controlled such that the calorific value does not exceed the effective cooling curve.

The controlling method according to the present invention is suitable for operation of a superconducting coil using an oxide high temperature superconductor.

More preferably, the controlling method according to the present invention is carried out in a temperature range not lower than 10 K.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the present invention, the thermal resistance between a refrigerator and a superconducting coil attached thereto is obtained. The unit of the thermal resistance is K/W (temperature difference between two certain points ΔT/calorific value difference between the two certain points ΔW). The thermal resistance value varies dependent on the cooling constitution between the refrigerator and the coil (material and size of the heat conducting member(s) existing between the refrigerator and the coil, for example). The thermal resistance can be obtained by calculation taking into consideration the thermal conductivity which depends on the material of the heat conducting member, and the cross section and length of the heat conducting member. Alternatively, the thermal resistance can be obtained by experiment through a simple experiment of thermal conduction. Further, an empirical value which can be reasonably applied to the cooling constitution may be adopted as the thermal resistance. A general value of the thermal resistance between the refrigerator and the coil is about 1 to about 4 K/W.

Figure 1:
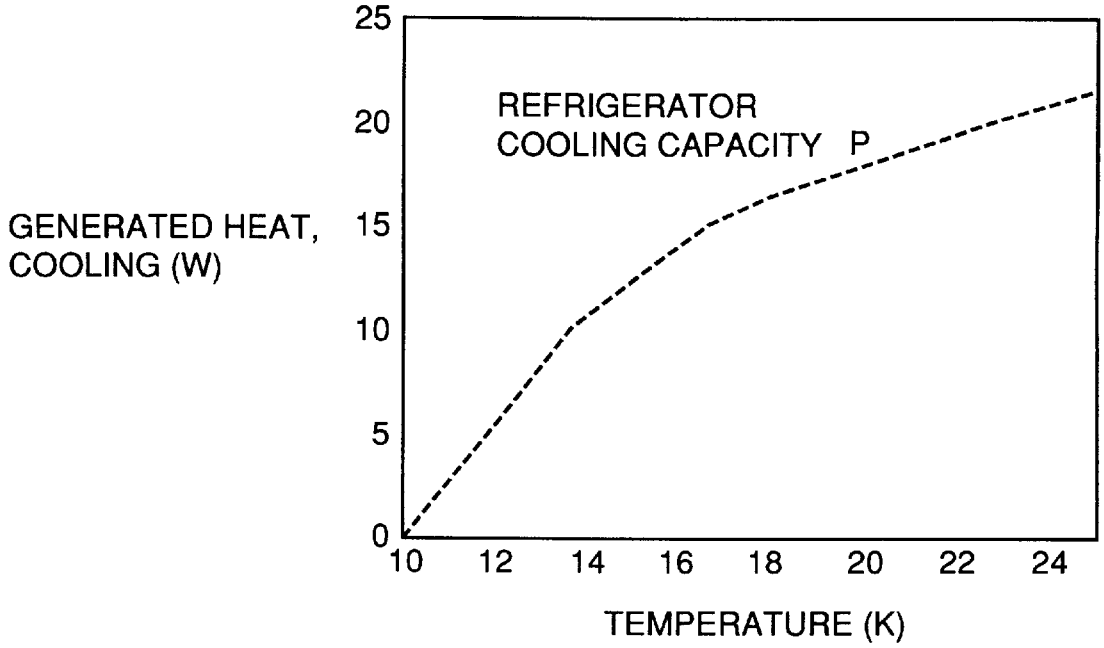
FIG. 1 shows an example of a refrigerator cooling capacity.

The effective cooling curve can be obtained in the following manner from the thermal resistance thus obtained and the rated cooling capacity of the refrigerator. The rated cooling capacity of the refrigerator is set depending on the type and structure of the refrigerator, and generally provided as an inherent characteristic of the refrigerator used. A specific example of the refrigerator cooling capacity is given in FIG. 1. The cooling capacity curve P shown in FIG. 1 indicates the cooling capacity of the refrigerator in which the capacity of the first cooling stage is 60 W (at 80 K) and the capacity of the second cooling stage is 16.5 W (at 20 K). This graph shows that when 5 W of heat is applied to the second cooling stage of the refrigerator, the temperature attains to about 12 K, and when 10 W of heat is applied, the temperature attains to about 14 K.

As to the thermal resistance described above, the following equation may be set.

Figure 2:
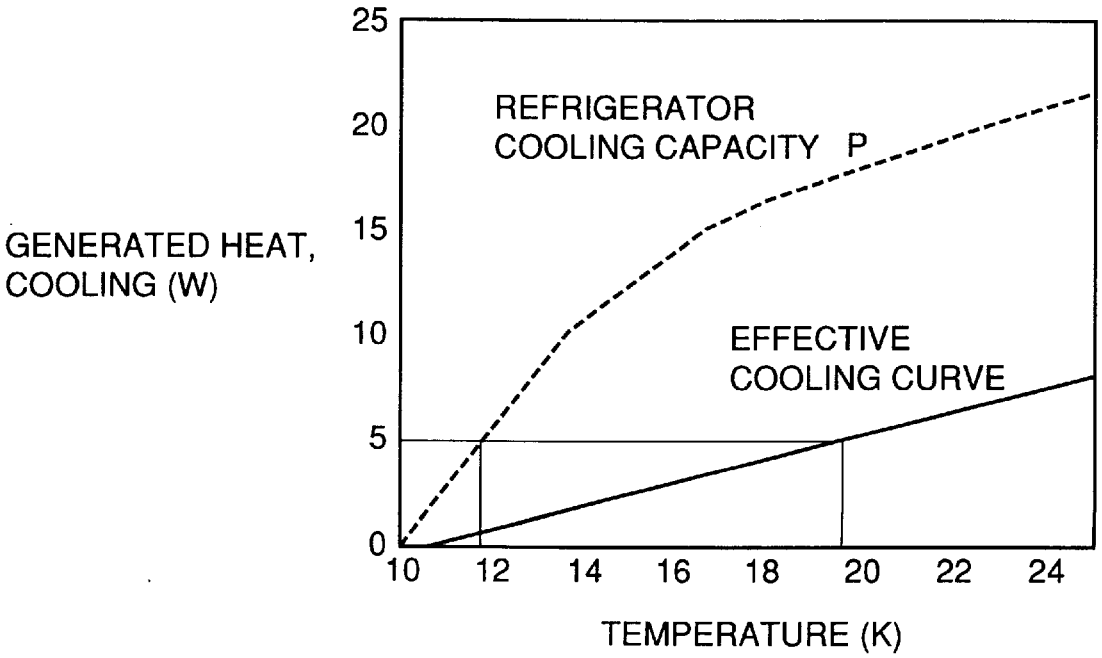
FIG. 2 shows an example of how the effective cooling curve is obtained from the refrigerator cooling capacity and the thermal resistance.

Thermal Resistance (K/W)=(Coil Temperature−Temperature of Cooling Stage)/Calorific Value of Coil Part From this relation and the cooling capacity of the refrigerator described above, the effective cooling curve can be obtained in the following manner. An example where the obtained thermal resistance is 1.5 K/W will be described in the following. For example, when the calorific value of the coil part is 5 W, the temperature difference generated between the coil and the cooling stage can be calculated as 5 (W)×1.5 (K/W)=7.5 (K). First, the refrigerator cooling capacity is only considered, and 5 W of heat results in a temperature of about 12 K. Then the above temperature difference is taken into consideration, and 19.5 K of the coil temperature is obtained, which is the temperature 12 K of the cooling stage plus the temperature difference 7.5 K. FIG. 2 shows a result of the plotted effective cooling curve according to such calculation.

In the present invention, the operation of the superconducting coil which is energized while being cooled by the refrigerator is controlled such that the calorific value of the superconducting coil at a prescribed temperature does not exceed the above-described effective cooling curve. More specifically, the operation temperature and/or operation current may be controlled so that the calorific value of the superconducting coil is under the effective cooling curve. In this case, the calorific curve in which the calorific values of the coil are plotted with respect to the coil temperature appears below the effective cooling curve. The calorific values and the calorific curve may be obtained by measurement, or may be obtained by calculation taking into consideration magnetic fields and temperatures of various portions of the coil. When the calorific values and the calorific curve are to be obtained by calculation, the coil may be divided into portions, the resistance of the superconducting wire constituting the coil may be calculated from the temperature and magnetic field of each portion, the calorific value may be calculated from the energized current and the resistance value, and then the calorific values of the respective portions may be summed up to obtain the total calorific value of the coil. When the resistance of the superconducting wire is calculated, the critical current density (Jc) of the wire may be obtained first and then the resistance of the wire may be obtained from the Jc. As to the method of calculating the Jc value, a method described in Proceedings of the 8th International Workshop on CRITICAL CURRENTS IN SUPERCONDUCTORS 27–29 May 1996, pp 471–474 may be used, for example. When the calorific values and the calorific curve are obtained by experiment, an excitation test may be carried out with the coil temperature and energized current used as parameters and then the calorific values may be calculated from the energized current values and the generated voltages of the coil.

Conventionally, it has been common that the superconducting coil is operated in the condition that the coil not exothermic. According to the present invention, however, even when the coil is in a exothermic condition, it is confirmed that stable operation is possible if the calorific value is sufficiently lower than the effective cooling curve. In this manner, a range ensuring stable operation can be set, and stable operation can be performed with an energized current as large as possible. In the range below the effective cooling curve, stable operation is possible without causing quenching of the coil. Generally, when heat is generated in the superconducting coil, the calorific value thereof increases with the rise of temperature. The tendency of the increase can be expected by calculation. Therefore, when the calorific value becomes high at a certain point and it is expected that the calorific value may possibly exceed the effective cooling curve as the temperature is increased, the control such as immediate reduction of the energized current may be performed so as to maintain the stable operation. The control method of the present invention as described above is applicable to automatic control of the refrigerator conduction cooling type coil equipped with an appropriate control apparatus.

Further, according to the present invention, the range in which stable operation is possible can be obtained by calculation without carrying out a marginal test of the superconducting coil. Therefore, damage to the coil by the marginal test can be avoided.

The type of the superconductor employed in the present invention is not specifically limited. The present invention, however, is especially advantageous when high temperature superconductors such as oxide superconductors having high stability are employed. While the present invention is applicable at cryogenic temperatures (around 4 K) at which specific heat is small and disturbance is more affectable, the present invention is particularly effective in a temperature range not lower than 10 K in which specific heat is larger and influence of disturbance is smaller. The shape of the superconductor used for the present invention is not specifically limited.

According to an aspect of the present invention, while the superconducting coil is being operated, the temperature of the superconducting coil may be monitored. When the monitored temperature becomes not less than a preset allowable limit value, the energized current of the superconducting coil is controlled. Such an allowable limit value of the temperature may be obtained by the following manner, for example. As already described, the calorific value and the calorific curve are obtained by calculation for a prescribed energized current. The obtained calorific curve and the effective cooling curve are plotted on the same graph. A highest temperature at the portion of the calorific curve which is lower than the effective cooling curve (the temperature at an intersecting point of the effective cooling curve and the calorific curve) is obtained. The obtained temperature or a temperature lower than that in the vicinity may be used as the allowable limit value. The allowable limit value of the temperature differs dependent on the magnitude of the energized current. Therefore, it is preferable to obtain the allowable limit value for each of a plurality of energized currents. On the other hand, since, generally, the larger the energized current, the lower the allowable limit value of the temperature, only the allowable limit value of the temperature for the maximum available energized current may be obtained. In actual operation, when the monitored temperature does not exceed the allowable limit value, the calorific value in the superconducting coil does not exceed the effective cooling curve, and therefore stable operation is possible. When the monitored temperature becomes not less than the allowable limit value of the temperature, quenching can be avoided by controlling the energized current.

According to another aspect of the present invention, the voltage generated in the superconducting coil may be monitored while the superconducting coil is in operation. The generated voltage is one which is derived from the electric resistance of the coil. The voltage derived from the electromagnetic induction is excluded from the voltage to be monitored. The energized current of the superconducting coil is controlled when the monitored voltage becomes not less than a preset allowable limit value. The allowable limit value of the voltage can be obtained by the following manner, for example. As already described, the calorific value and the calorific curve are obtained for a prescribed energized current. The obtained calorific curve and the effective cooling curve are plotted on the same graph. The highest heat amount at the portion of the calorific curve which is lower than the effective cooling curve (the heat amount at an intersecting point of the effective cooling curve and the calorific curve) is obtained. By dividing the obtained heat amount by the prescribed energized current, the corresponding generated voltage can be obtained. The obtained voltage or a voltage lower than that in the vicinity may be used as the allowable limit value. The allowable limit value of the voltage differs dependent on the magnitude of the energized current. Therefore, it is preferable to obtain the allowable limit value for each of a plurality of energized currents. On the other and, since, generally, the larger the energized current, the lower the allowable limit value of the voltage, only the allowable limit value of the voltage for the maximum available energized current may be obtained. In the actual operation, when the monitored voltage does not exceed the allowable limit value, the calorific value of the superconducting coil does not exceed the effective cooling curve, and therefore stable operation is possible. When the monitored voltage becomes not less than the allowable limit value, quenching can be avoided by controlling the energized current.

In the present invention, the above described monitoring of the temperature and the above described monitoring of the voltage may be performed simultaneously. It is possible to avoid quenching by controlling the energized current when the monitored temperature and/or monitored generated voltage becomes not less than the allowable limit value.

When a DC current is applied to the superconducting coil, the calorific value of the superconducting coil can be considered as the calorific value derived from the electric resistance of the superconducting coil. When an ac current is applied to the superconducting coil, the calorific value of the superconducting coil can be obtained as the sum of the calorific value derived from ac loss of the superconducting coil and the calorific value derived from the electric resistance of the superconducting coil.

The ac loss can be measured by an excitation test. In the excitation test, the ac loss can be obtained from the product of the voltage value excluding a component resulting from the electromagnetic induction and the current value, or from the product of the temperature increase in the heat insulated state and the specific heat.

The ac loss may also be obtained by calculation. Though the ac loss is generated by various causes, generally, the ac loss can be obtained as the sum of the losses caused by two main factors, hysteresis loss and coupling loss, as shown in the following formulas.

$$P=P_{hf}+P_{cf}$$

$$P_{hf}=2\mu_0 H_m^2 \beta f/3 \quad (\beta<1)$$

$$P_{hf}=2d\mu_0 J_c H_m(1-2/3\beta)f \quad (\beta>1)$$

$$\beta=H_m/H_p,\ H_p=J_c d$$

$$P_{cf}=\Gamma_c \cdot \mu_0 H_m^{2} \cdot 2\pi f^2 \tau_s/2\{(2\pi f\tau_s)^2+1\}$$

$$\tau_s=(\mu_0/2\rho_n)\cdot(l/2)^2$$

P: ac loss [w/m$^3$]

$P_{hf}$: hysteresis loss [w/m$^3$]

$P_{cf}$: coupling loss [w/m$^3$]

$\mu_0$: magnetic permeability under vacuum $H_m$: maximum magnetic field on superconductor surface $J_c$: critical current density of superconductor d: half the thickness of superconductor f: frequency [Hz]

$\Gamma_c$: constant $\tau_s$: time constant $\rho_n$: resistivity of normally conducting metal l: width of normally conducting metal

EXAMPLE 1

Figure 3:
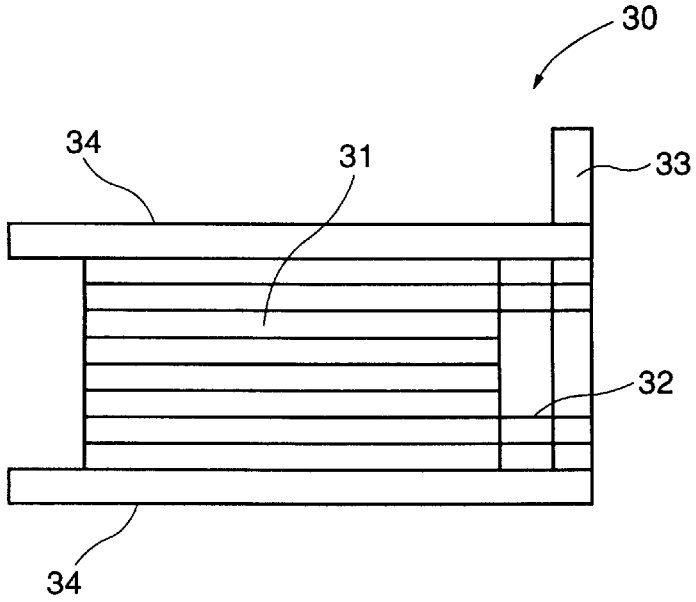
FIG. 3 is a schematic diagram showing the structure of the high temperature superconducting coil used in Example 1.
Figure 4:
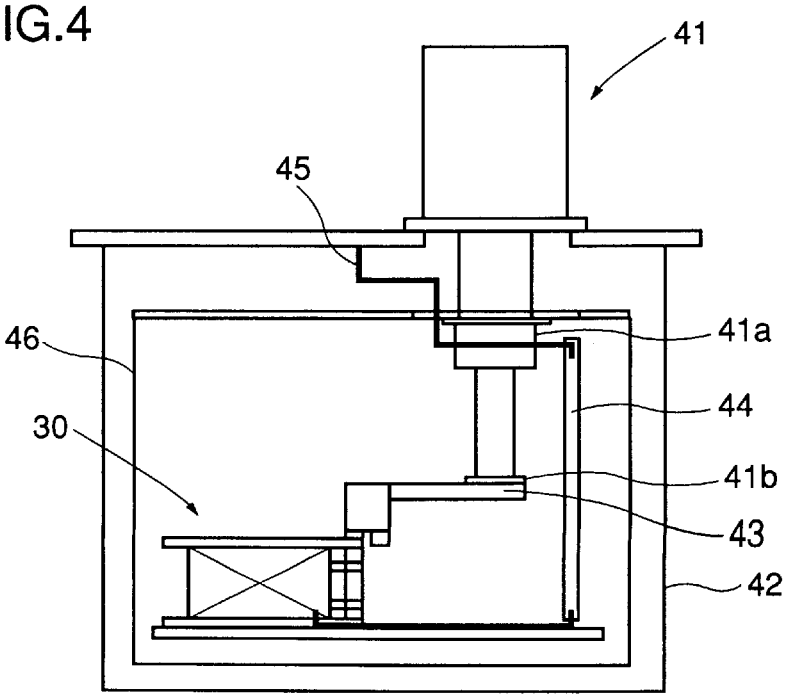
FIG. 4 is a schematic diagram showing the connection structure between the refrigerator and the high temperature superconducting coil used in Example 1.

A bundle of three Bi2223 silver sheathed bismuth based superconducting wires (3.6±0.4 mm×0.23±0.02 mm) were wound with a polyimide tape having a thickness of about 13 μm and an SUS tape having a thickness of about 0.1 mm, to fabricate a double pancake coil having an inner diameter of 80 mm, an outer diameter of about 300 mm and a height of about 8 mm. The silver ratio of the superconducting wire used was 2.4, and the critical current thereof was 35 to 45 A (77 K). Eight of the fabricated double pancake coils were stacked in layer and joined. The double pancake coils were insulated from each other with FRP sheets of 0.1 mm thickness. As shown in FIG. 3, cooling plate 32 of copper is inserted between each pair of the double pancake coils 31, and each cooling plate 32 was joined to thermal conduction bar 33 of copper. The stacked double pancake coils 31 were placed between a pair of FRP plates 34, and thus high temperature superconducting coil structure 30 was completed. The fabricated high temperature superconducting coil was attached to the refrigerator as shown in FIG. 4. First stage 41*a* and second stage 41*b* as the cooling stages of refrigerator 41 are accommodated in heat insulating vessel 42. Copper plate 43 is fixed to second stage 41*b*. High temperature superconducting coil 30 is attached to second stage 41*b* of refrigerator 41 through copper plate 43. Current lead 44 of an oxide high temperature superconducting wire is provided extending from high temperature superconducting coil 30 to the thermal anchor of first stage 41*a*. Current lead 44 effectively suppresses heat entrance. Current lead 45 of copper was used from the thermal anchor of first stage 41*a* to room temperature. High temperature superconducting coil 30 is covered with heat shield plate 46 for intercepting the entrance of heat radiation. Heat insulating vessel 42 is evacuated to vacuum. Coil packing ratio of superconducting coil 30 was 75%.

From the material and the size of the heat conductive members existing between the second cooling stage of the refrigerator and the high temperature superconducting coil, the thermal resistance was set by calculation to 1.5 K/W. Then, using the thermal resistance value of 1.5 K/W, the effective cooling curve was obtained from the cooling capacity curve of the refrigerator as described above.

Figure 5:
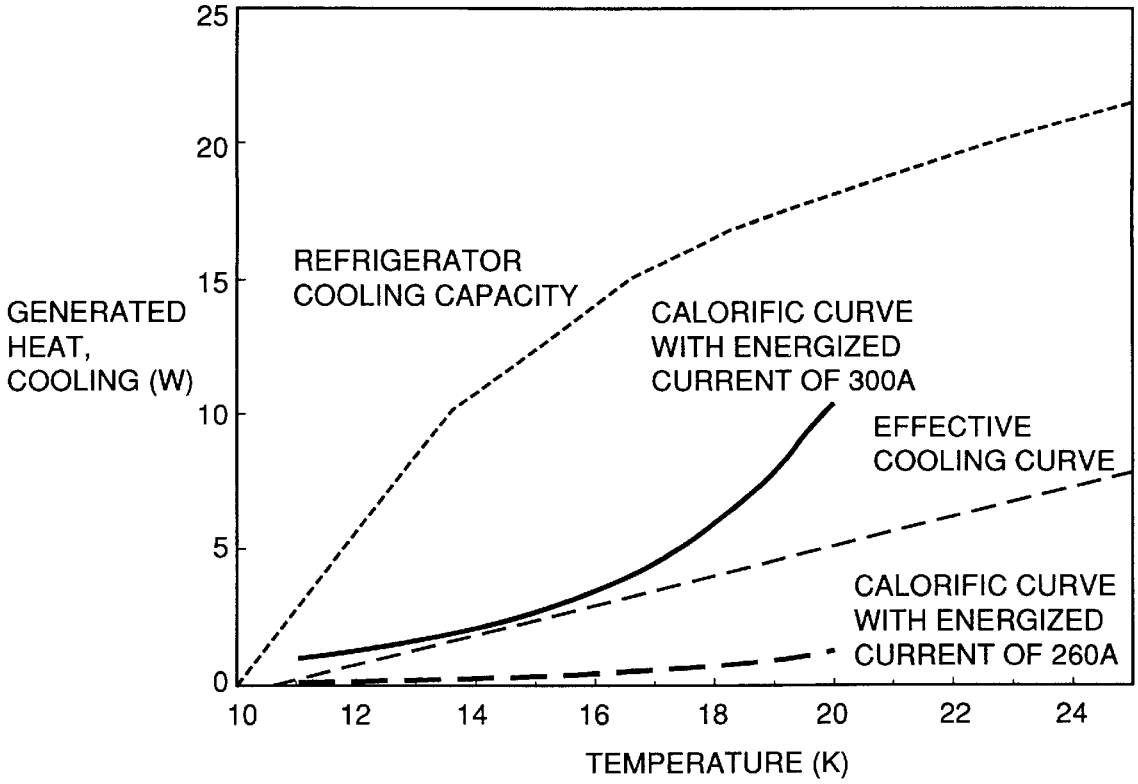
FIG. 5 shows the relation between the calorific curve of the coil and the effective cooling curve in Example 1.

The refrigerator was driven and excitation tests were performed. The temperature of the coil was 11 K. In the operation with an energized current of 260 A (generated central magnetic field of about 3.5 T), the calorific curve was below the effective cooling curve, and the operation was able to be maintained for a long time more than 2 days. On the other hand, in the operation with an energized current of 300 A (generated central magnetic field of about 4 T), the calorific curve was above the effective cooling curve, and the coil temperature was increased, so that the stable operation was not possible. The relation between the coil calorific curve and the effective cooling curve is shown in FIG. 5. From the experiments described above, it was confirmed that stable operation of the coil is possible in the range where the effective cooling curve is above the calorific curve.

EXAMPLE 2

Figure 6:
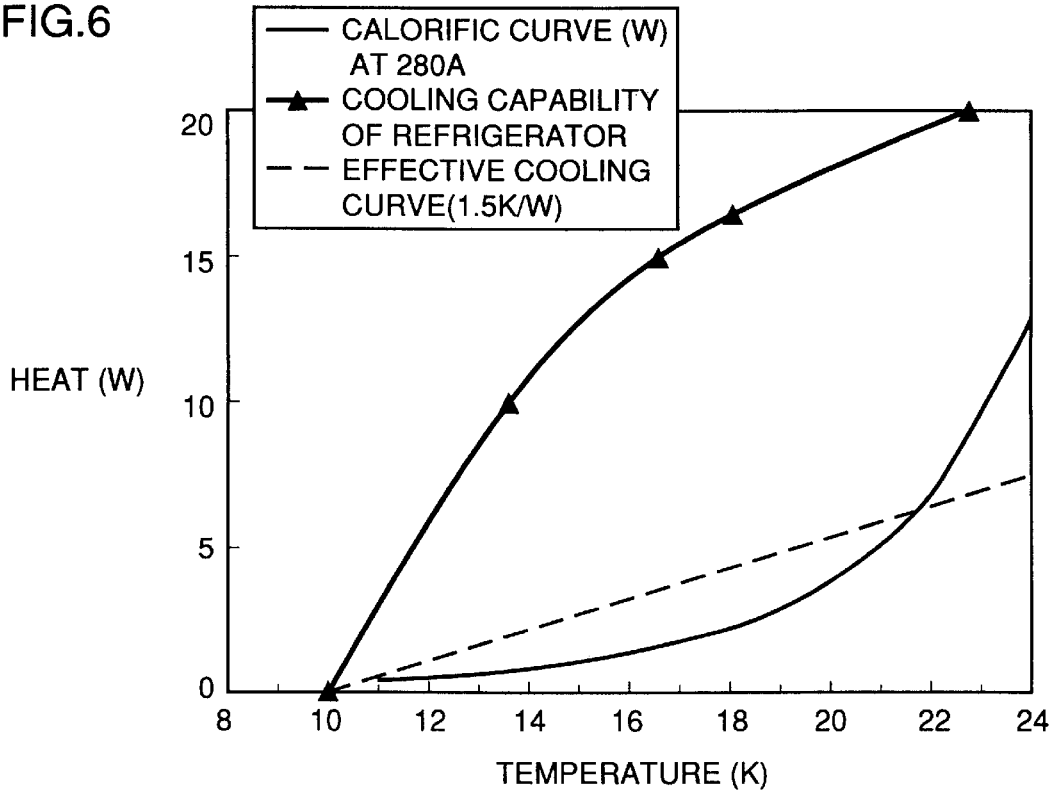
FIG. 6 shows the relation between the coil calorific curve and the effective cooling curve in Example 2.

Assuming that a current of 280 A was applied to the coil of Example 1, the calorific value and the calorific curve were obtained by the above described calculation. The obtained calorific curve is shown in FIG. 6. The effective cooling curve is also plotted on the same graph. The temperature at an intersecting point of the effective cooling curve and the calorific curve was about 21.7 K, and the heat amount at the point was about 6.4 W. The voltage generated at the point was calculated as 6.4 W/280 A=22.9 mV. The calorific value of the coil would not exceed the effective cooling curve in the actual operation if the temperature is lower than 21.7 K. Similarly, the calorific value of the coil would not exceed the effective cooling curve in the actual operation if the generated voltage is smaller than 22.9 mV. Since there may be an error in the measurements of temperature and voltage, a margin is taken into consideration, and the allowable limit value of the temperature was set, from 21.9 K, to 21 K (a margin of 0.7 K), and the allowable limit value of the generated voltage was set, from 22.9 mV, to 20 mV (a margin of 2.9 mV). A system was constructed which was operated while the temperature and the generated voltage of the superconduting coil were measured, and in which the current was rapidly reduced to 0 when each measured value attained to be not lower than each allowable limit value. In this system, excitation up to 280 A took ten minutes. As a result, though the coil temperature was increased slightly at the time of excitation, quenching was not experienced and stable operation was possible.

EXAMPLE 3

Figure 7:
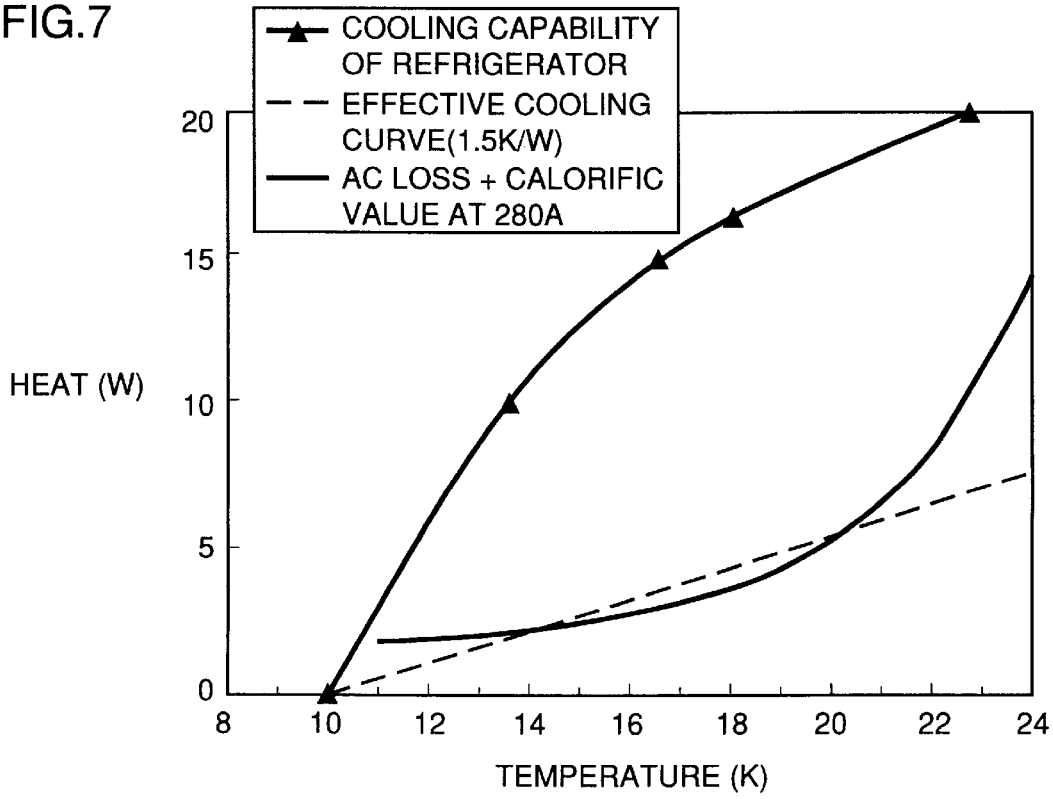
FIG. 7 shows the relation between the coil calorific curve and the effective cooling curve in Example 3.

In the coil of Example 1, ac excitation of 0.006 Hz was performed, and the ac loss was measured. The measured ac loss was 1.5 W. By adding 1.5 W to the calorific value obtained in Example 2, the calorific value under the ac excitation was obtained. The obtained calorific curve is as shown in FIG. 7. The effective cooling curve is also plotted on the same graph. The temperature at an intersecting point of the effective cooling curve and the calorific curve was about 20 K, and the heat amount at the point was about 5.4 W. The voltage generated at the point was calculated as 5.4 W/280 A=19.3 mV. The calorific value of the coil would not exceed the effective cooling curve in the actual ac operation if the temperature is lower than 20 K. Similarly, the calorific value of the coil would not exceed the effective cooling curve in the actual ac operation if the generated voltage is smaller than 19.3 mV. As there may be an error in the measurements of temperature and voltage, a margin was taken into consideration, and the allowable limit value of the temperature was set, from 20 K, to 19 K (a margin of 1 K), and the allowable limit value of the generated voltage was set, from 19.3 mV, to 19 mV (a margin of 0.3 mV). A system was constructed which was operated while the temperature and the generated voltage of the superconducting coil were measured, and in which the current was rapidly reduced to 0 when each measured value attained to be not lower than each allowable limit value. In the system, ac excitation of 0.006 Hz was continued for 1 hour. As a result, stable operation without quenching was possible.

As described above, by the system in which the allowable limit values are set, the performance of the superconducting coil can fully be exhibited.

According to the present invention, stable operation of the superconducting coil can be continued without causing quenching. Especially, according to the present invention, even when there is heat generated in the coil, conditions for stable operation can immediately be set. The present invention is useful for the operation control of superconducting magnets.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of controlling an operation of a refrigerator conduction cooling type superconducting coil, comprising the steps of:

obtaining thermal resistance between said refrigerator and the superconducting coil connected to a cooling stage of said refrigerator;

obtaining an effective cooling curve representing the relation between temperature and amount of heat from a rated cooling capacity of said refrigerator and said thermal resistance; and controlling an operation of said superconducting coil which is energized while being cooled by said refrigerator such that a calorific value of said superconducting coil at a prescribed temperature does not exceed said effective cooling curve.

2. The method according to claim 1, wherein said method comprises the step of obtaining a calorific value from an energized current of said superconducting coil and a resistance value of said superconducting coil, and the energized current of said superconducting coil is controlled such that said calorific value does not exceed said effective cooling curve.

3. The method according to claim 1, wherein an oxide high temperature superconductor is used in said superconducting coil.

4. The method according to claim 2, wherein an oxide high temperature superconductor is used in said superconducting coil.

5. The method according to claim 1, wherein said control is performed in a temperature range not lower than 10K.

6. The method according to claim 2, wherein said control is performed in a temperature range not lower than 10K.

7. The method according to claim 3, wherein said control is performed in a temperature range not lower than 10K.

8. The method according to claim 1, wherein said method comprises the step of monitoring a temperature of said superconducting coil while said superconducting coil is in operation; and the energized current of said superconducting coil is controlled when said temperature becomes not less than a preset allowable limit value.

9. The method according to claim 1, wherein said method comprises the step of monitoring a voltage generated by the electric resistance in said superconducting coil while superconducting coil is in operation; and the energized current of said superconducting coil is controlled when said generated voltage becomes not less than a preset allowable limit value.

10. The method according to claim 8, wherein said method comprises the step of monitoring a voltage generated by the electric resistance in said superconducting coil while superconducting coil is in operation; and the energized current of said superconducting coil is controlled when said generated voltage becomes not less than a preset allowable limit value.

11. The method according to claim 1, wherein the current applied to said superconducting coil is an ac current; and said calorific value of said superconducting coil is obtained as the sum of a calorific value derived from ac loss of said superconducting coil and a calorific value derived from the electric resistance of said superconducting coil.

* * * * *